United States Patent [19]

Hipp

[11] Patent Number: 4,462,471

[45] Date of Patent: Jul. 31, 1984

[54] BIDIRECTIONAL FLUID OPERATED VIBRATORY JAR

[76] Inventor: James Hipp, 110 Lietmeyer, New Iberia, La. 70560

[21] Appl. No.: 437,118

[22] Filed: Oct. 27, 1982

[51] Int. Cl.[3] ..... E21B 4/14

[52] U.S. Cl. ..... 175/296; 175/299; 175/300

[58] Field of Search ..... 175/293, 296, 297, 299, 175/300, 304; 173/78, 80, 91

[56] References Cited

U.S. PATENT DOCUMENTS

| | | | |
|---|---|---|---|
| 1,775,673 | 9/1930 | Fields | 175/293 |
| 2,199,969 | 5/1940 | Hamm | 175/304 |
| 2,721,056 | 10/1955 | Storm | 175/297 |
| 2,800,884 | 7/1957 | Mori | 173/78 |
| 3,392,795 | 7/1968 | Greer | 175/300 |
| 3,562,807 | 2/1971 | Slator et al. | 175/297 |
| 3,804,185 | 4/1974 | Mason | 175/297 |
| 3,853,187 | 12/1974 | Sutliff et al. | 175/297 |
| 3,987,858 | 10/1976 | Slator et al. | 175/297 |
| 4,186,807 | 2/1980 | Sutliff et al. | 175/300 |

FOREIGN PATENT DOCUMENTS

| | | | |
|---|---|---|---|
| 2085054 | 4/1982 | United Kingdom | 175/296 |
| 2089400 | 6/1982 | United Kingdom | 175/293 |

*Primary Examiner*—Frank T. Yost
*Assistant Examiner*—Hien H. Phan
*Attorney, Agent, or Firm*—Bernard A. Reiter

[57] ABSTRACT

Disclosed is a bidirectional fluid operated jarring apparatus. The apparatus includes a tubular body having a lower end defining a downwardly facing body hammer. A tubular knocker sub is axially slidingly mounted to the body adjacent the body hammer and includes an upwardly facing anvil engageable with the body hammer and spaced apart oppositely facing internal hammers, the upper one of which defines an internal anvil. A tubular mandrel having a low passage therethrough is axially movably mounted in the body and knocker sub. The mandrel includes a hammer positioned within the knocker sub between the internal shoulders. A valve is provided for closing the mandrel flow passage so that fluid pressure urges the mandrel axially downwardly with respect to the body and opening the mandrel flow passage upon predetermined downward movement of the mandrel. When the knocker sub is in a retractive position, the apparatus produces a downward jarring force. When the knocker sub is in an extended position, the apparatus produces an upward jarring force.

12 Claims, 19 Drawing Figures

BIDIRECTIONAL FLUID OPERATED VIBRATORY JAR

BACKGROUND OF THE INVENTION

A. Field of the Invention

The present invention relates generally to impact or jarring tools, and more particularly, to a fluid operated jarring tool for use in well bores that jars upwardly when the tool is in tension and downwardly when the tool is in compression.

B. Description of the Prior Art

In downhole well operations, there is a need for jarring or impact devices. For example, in workover operations using coiled tubing or snubbing equipment, it is necessary to provide downward jarring impact at the bottom of the string to enable the string to pass obstructions or otherwise enter the well. During fishing operations or other operations, such as paraffin scraping, it is sometimes necessary to apply upward jarring or impact forces at the bottom of the string if the fishing tool or the like becomes stuck.

In my prior U.S. Pat. No. 3,946,819, I disclose a fluid operated well tool adapted to deliver downward jarring forces when the tool encounters obstructions. The tool of my prior U.S. Pat. No. 3,946,819, generally includes a housing with a tubular stem member telescopically received in the housing for relative reciprocal movement between a first terminal position and a second terminal position in response to fluid pressure in the housing. The lower portion of the housing is formed to define a downwardly facing hammer and the stem member includes an upwardly facing anvil which is positioned to be struck by the hammer. The tool includes a valve assembly that is responsive to predetermined movement of the stem member toward the second terminal position to relieve fluid pressure and permit the stem member to return to the first terminal position. When the valve assembly relieves fluid pressure, the hammer moves into abrupt striking contact with the anvil. The tool of my prior U.S. Pat. No. 3,946,819, is very effective in providing downward repetitive blows. However, the tool of my prior patent will not produce upwardly directed blows.

In U.S. Pat. No. 3,361,220, there is disclosed a jarring or drilling mechanism that may be adapted to provide upward or downward, or upward and downward blows. The mechanism of the '220 patent includes a housing having opposed axially spaced apart anvil surfaces and an impact element or hammer having opposed axially spaced apart hammer surfaces slidingly mounted within the housing between the anvil surfaces. A spring is provided for urging the hammer upwardly. When it is desired to use the mechanism of the '220 patent for jarring, a valve including a closure and a compression spring is dropped down the string to the mechanism.

In general, the mechanism of the '220 patent operates by fluid pressure acting on the valve and hammer to urge the valve and hammer axially downwardly until the downward movement of the valve is stopped, preferably by the full compression of the valve spring. When the downward movement of the valve stops, the seal between the valve and the hammer is broken and the valve moves axially upwardly.

The direction of jarring of the mechanism of the '220 patent is determined by the relationship between the fluid pressure and the strength of the spring that urges the hammer upwardly. Normally, the mechanism is adapted for upward jarring. When the valve opens, the hammer moves upwardly to strike the downwardly facing anvil surface of the housing. The mechanism can be made to deliver a downward and upward blow by increasing the fluid pressure and decreasing the strength of the spring that urges the hammer upwardly. When the mechanism is so arranged, the downward momentum of the hammer is increased such that the hammer strikes the upwardly facing anvil of the housing prior to being urged upwardly to strike the downwardly facing anvil surface. The mechanism of the '220 patent can be adapted to produce only downward forces by either shortening the length of the valve spring or by lengthening the valve such that the valve recloses prior to the hammers reaching the downwardly facing anvil surface on the upstroke.

A primary shortcoming of the mechanism of the '220 patent is in its inability to provide bidirectional impacts without modifying the mechanism. A further shortcoming of the mechanism of the '220 patent is in its inability to provide either an upward jarring force or a downward jarring force depending upon the wishes of the operator when the mechanism is downhole. Yet a further shortcoming of the mechanism of the '220 patent is in its rather limited effectiveness in producing downward impacts, in that the downward force on the hammers is provided solely by its momentum, which is opposed by both fluid pressure and the spring urging the hammer upwardly.

It is therefore an object of the present invention to provide an apparatus which overcomes the shortcomings of the prior art. More particularly, it is an object of the present invention to provide a bidirectional fluid operated jarring apparatus that produces strong jarring forces in either the upward or downward direction. It is a further object of the present invention to provide a jarring apparatus that can be used to provide upward or downward impact forces as desired downhole without modifying the tool. It is a further object of the present invention to provide an apparatus that provides downward jarring forces when the tool is in compression, as when the tool is being run downwardly, and which produces strong upward forces when the tool is in tension, as when the tool is being pulled upwardly.

SUMMARY OF THE INVENTION

The foregoing and other objects are achieved by the apparatus of the present invention. The apparatus includes a tubular body having an upper end that includes a pipe connection and a lower end that is formed to define a downwardly facing hammer. A tubular knocker sub is axially movably mounted at the lower end of the body and includes a pipe connection at its lower end. The knocker sub includes an upwardly facing anvil which cooperates with the hammer of the body to produce downwardly directed jarring forces. The knocker sub also includes an inwardly extending downwardly facing internal shoulder and an axially spaced apart upwardly facing internal shoulder. A tubular mandrel having an axial flow passage therethrough is mounted for axial movement in the body and knocker sub. The mandrel includes a hammer positioned between the opposed internal shoulders of the knocker sub. The mandrel hammer includes an upwardly facing shoulder which is engageable with the downwardly facing internal anvil to produce upward jarring forces and a downwardly facing shoulder which is engageable with the upwardly facing internal shoulder of the knocker sub. A spring is provided for urging the mandrel axially upwardly with respect to the body. A valve is provided for closing the mandrel flow passage such that fluid pressure urges the mandrel axially downwardly with respect to the body until the mandrel moves axially downwardly a predetermined amount whereupon the valve opens.

When the apparatus of the present invention is in compression, as when a downward force is applied to the apparatus, the knocker sub is in a retracted position with respect to the body. When the knocker sub is in the retracted position, the body hammer initially contacts the upwardly facing anvil of the knocker sub. Upon application of fluid pressure to the closed mandrel, the downwardly facing shoulder of the mandrel hammer engages the upwardly facing internal shoulder of the knocker sub. The body reacts to the downward force on the mandrel and knocker sub by moving upwardly, thereby to space axially apart the body hammer and upwardly facing anvil of the knocker sub. When the valve opens, the body falls downwardly and the body hammer strikes the upwardly facing anvil of the knocker sub to produce a downward jarring blow.

When the apparatus of the present invention is in tension, as when the apparatus is being pulled upwardly, the knocker sub is pulled downwardly with respect to the body to an extended position. In the extended position, the body hammer and upwardly facing anvil of the knocker sub are spaced apart and the upwardly facing shoulder of the mandrel hammer is initially in contact with the downwardly facing anvil of the knocker sub. When the fluid pressure in the body urges the mandrel downwardly, the mandrel hammer moves downwardly axially apart from the downwardly facing internal anvil of the knocker sub. When the valve opens, the spring drives the mandrel axially upwardly until the mandrel hammer delivers a sharp blow to the downwardly facing anvil of the knocker sub.

In order to prevent the valve from reclosing prematurely, means are provided for momentarily releasably preventing axially upward movement of the mandrel after opening of the valve. In one embodiment of the present invention, the releasable preventing means includes an elastically yieldable bushing that wedgingly engages the mandrel and causes momentary sticking of the mandrel after the valve opens. In other embodiments of the invention, the releasable preventing means includes a positive locking mechanism.

In order to prevent the downward flow of mud through the apparatus from hindering or lessening the impact of the blow delivered by the apparatus, means are provided for momentarily interrupting the flow of fluid into the tool as the mandrel travels upwardly.

DESCRIPTION OF THE PREFERRED EMBODIMENT

Figure 1A:
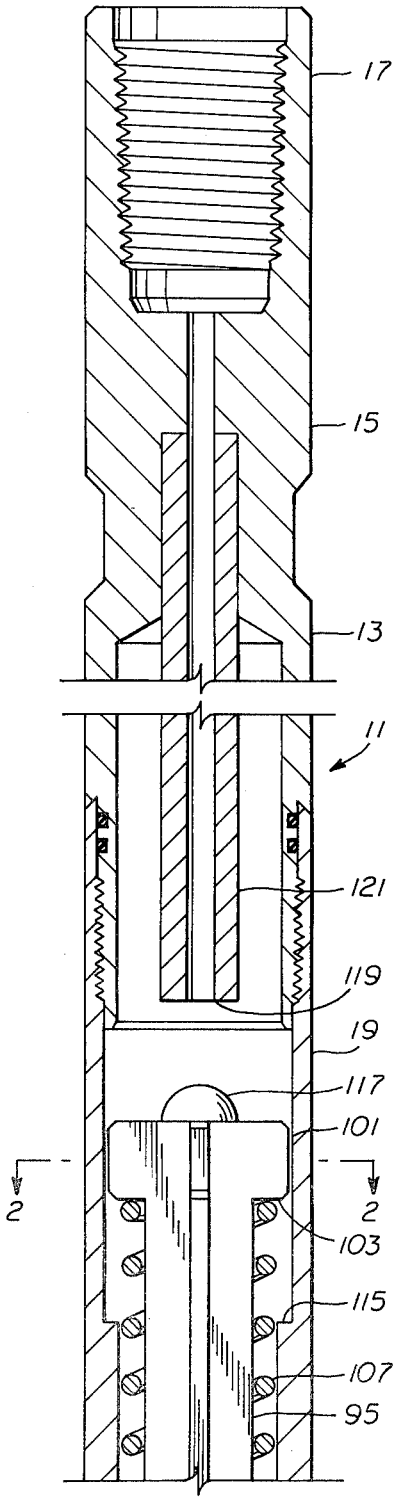
FIGS. 1A, 1B, 1C, and 1D are sectional views showing in detail the upper, upper middle, lower middle, and lower portions, respectively, of the preferred embodiment of the apparatus of the present invention.
Figure 2:
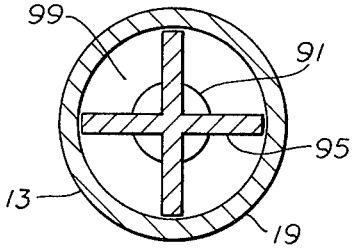
FIG. 2 is a sectional view taken along line 2—2 of FIG. 1A showing details of the construction of the valve mechanism of the present invention.
Figure 3:
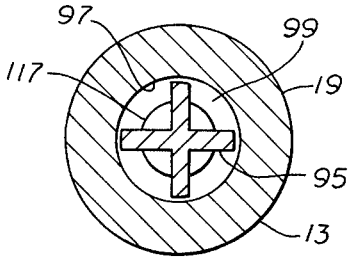
FIG. 3 is a sectional view taken along line 3—3 of FIG. 1B showing details of the fluid interrupting means of the present invention.

Referring now to the drawings, and first to FIGS. 1A–1D, the apparatus of the present invention is designated generally by the numeral 11. Apparatus 11 includes a tubular body 13, which for ease of assembly includes a plurality of segments, including, a top sub 15, which includes a pipe connection 17, a lower top sub 19 threadedly and sealingly connected to top sub 15, a middle sub 21 threadedly and sealingly connected to lower top sub 19, a releasable preventing means sub 23 sealingly and threadedly connected to middle sub 21, a lower middle sub 25 sealingly threadedly connected to releasable preventing means sub 23, and a hammer sub 27 sealingly threadedly connected to lower middle sub 25. The lower end of hammer sub 27 includes an annular downwardly facing hammer 29.

Figure 1B:
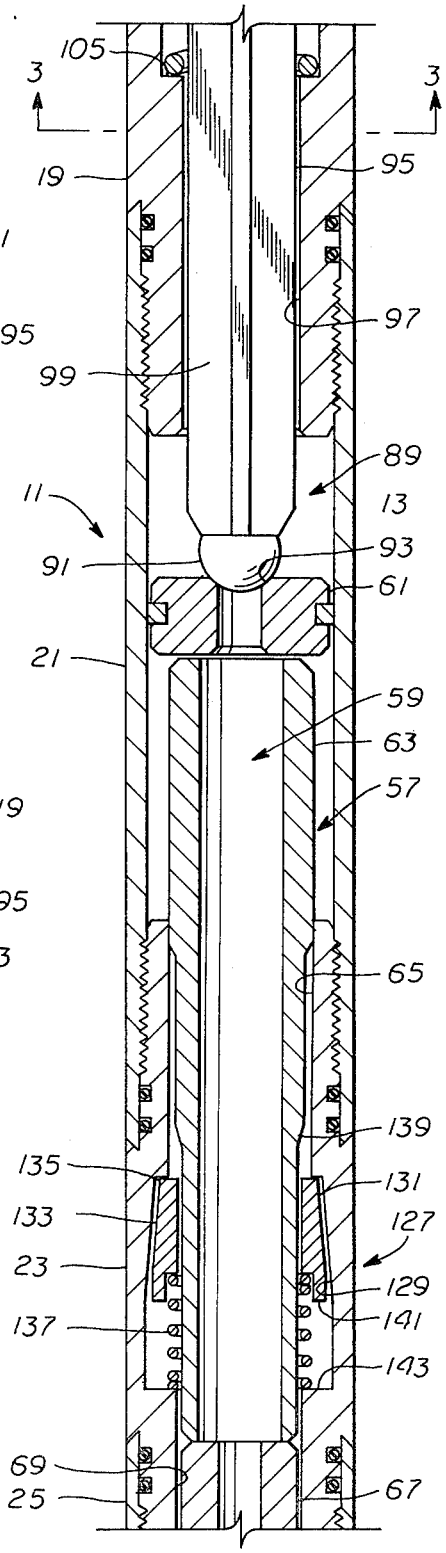
Figure 1C:
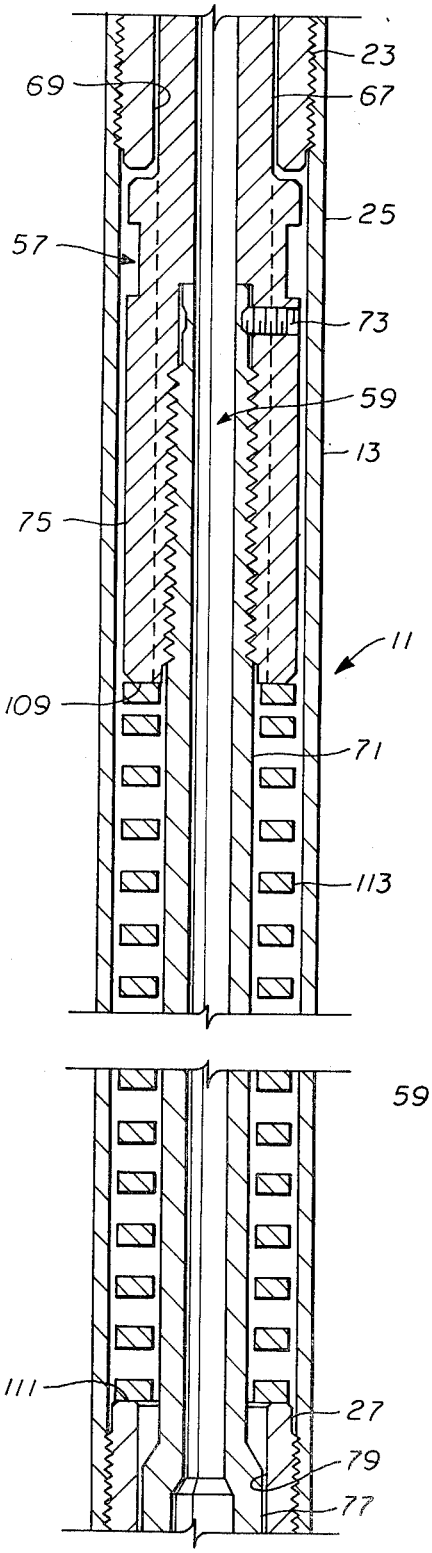
Figure 4:
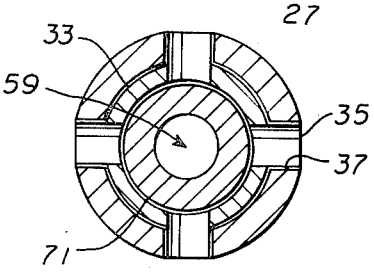
FIG. 4 is a sectional view taken along line 4—4 of FIG. 1D showing details of the connection between the body and knocker sub of the present invention.
Figure 1D:
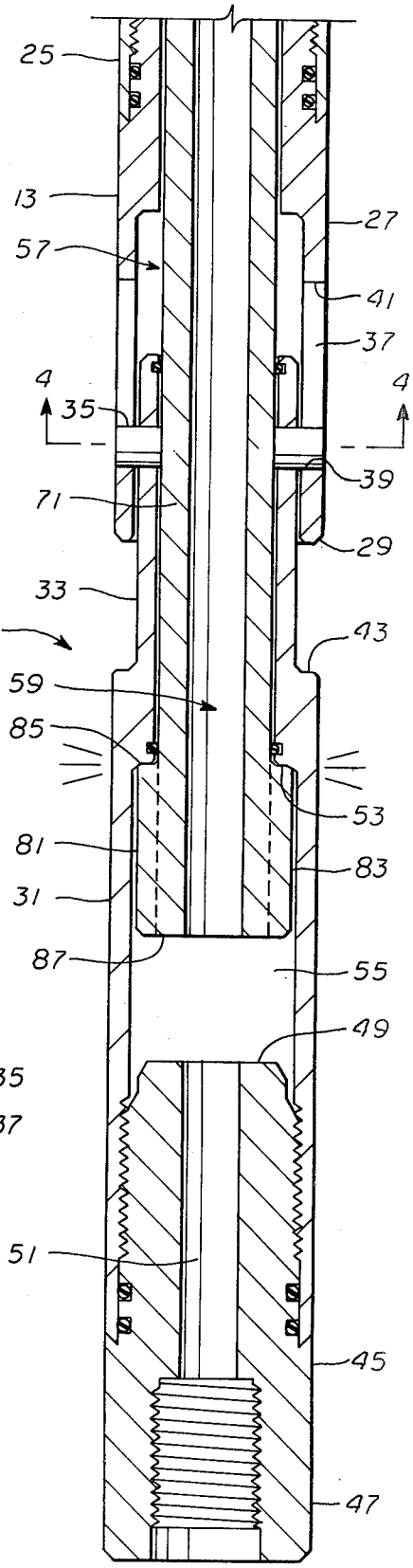
Figure 5:
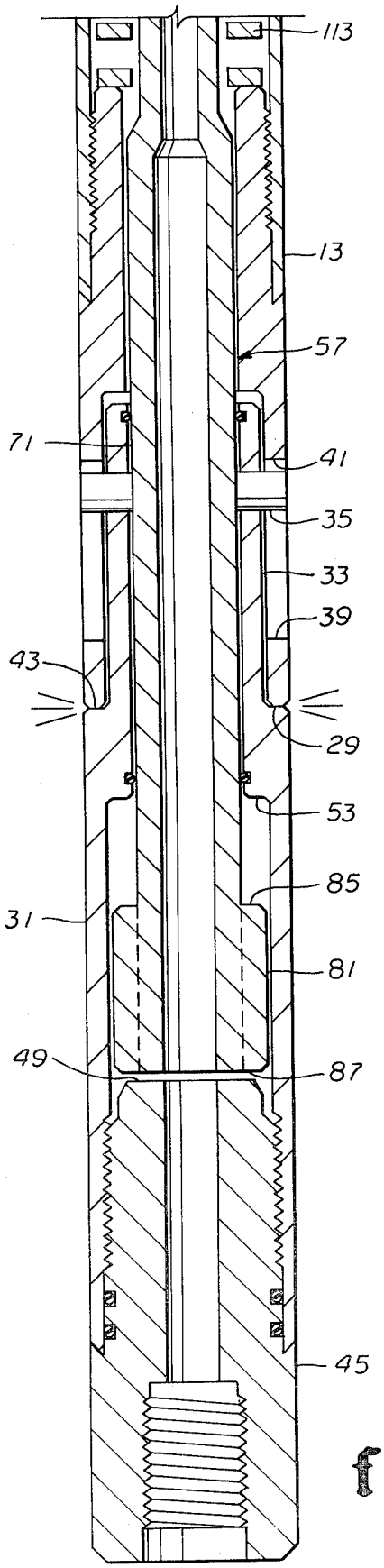
FIG. 5 is a sectional view similar to FIG. 1D showing the apparatus of the present invention operating in the downward jarring mode.

Referring now to FIG. 1D, apparatus 11 includes a knocker sub 31 mounted for limited axial movement with respect to hammer sub 27 of body 13. Knocker sub 31 includes a connecting neck 33 slidingly mounted within hammer sub 27. Limited axial movement of knocker sub 31 between an extended position as shown in FIG. 1D and a retracted position as shown in FIG. 5, is provided by a plurality of radially extending pins, including pin 35, which are slidingly engaged with a plurality of axially extending slots, including slot 37, in hammer sub 27. Slot 37 includes a lower end 39 and an upper end 41 with pin 35 being slidable therebetween.

Knocker sub 31 includes a radially outwardly extending upwardly facing shoulder which defines an anvil 43, which is adapted to be struck by body hammer 29 as shown in FIG. 5. The lower end of knocker sub 31 includes a connector 45 which has at its lower end a pipe connection 47 adapted for interconnection with downhole apparatus. The upper end of connector 45 is threadedly and sealingly engaged with the inside of knocker sub 31 and defines an upwardly facing shoulder 49. Connector 45 has an axial flow passage 51 therethrough.

Knocker sub 31 has formed therein axially above shoulder 49 a downwardly facing shoulder which forms an internal anvil 53. Between anvil 53 and upwardly spacing shoulder 49 there is defined a cavity 55.

Referring now to FIGS. 1B–1D, apparatus 11 includes a mandrel designated generally by the numeral 57 axially slidingly mounted within body 13 and knocker sub 31. Mandrel 57 has a flow passage, designated generally by the numeral 59, formed axially therethrough.

As shown in FIG. 1B, mandrel 57 includes a piston 61 axially slidingly sealingly mounted within middle sub 21 of body 13. Mandrel 57 includes axially below piston 61 an upper tubular portion 63 which may or may not be structurally interconnected with piston 61. Upper tubular portion 63 is slidingly mounted in a bushing portion 65 defined by the upper end of releasable preventing means sub 23 of body 13. Mandrel 57 also includes a lower tubular portion 67 axially slidingly mounted in a bushing 69 defined by the lower portion of releasable preventing means sub 23. Again, lower tubular portion 67 of mandrel 57 may or may not be structurally interconnected with upper tubular portion 63 of mandrel 57. Mandrel 57 finally includes a hammer portion 71 threadedly connected to the lower end of lower tubular portion 67 and slidingly sealingly mounted within knocker sub 31. A set screw 73 is provided to interengage and increase the structural connection between lower tubular portion 67 and hammer portion 71.

The lower end of lower tubular portion 67 is formed to include a plurality of radially outwardly extending ribs, including rib 75 which serve to guide and maintain axial alignment of mandrel 57 within lower middle sub 25 of body 13. Hammer portion 71 of mandrel 57 has a radially enlarged portion 77 which cooperates with a bushing 79 defined by the upper end of hammer sub 27 of body 13 which further serves to maintain axial alignment of mandrel 57 within body 13.

The extreme lower end of hammer portion 71 of mandrel 57 is formed to define a radially outwardly extending hammer 81 which is axially movably contained in cavity 55 between internal anvil 53 and upwardly facing shoulder 49. Hammer 81 is formed by a plurality of ribs, including rib 83 and includes an upwardly facing shoulder 85 which is engageable with internal anvil 53 of knocker sub 31, as shown in FIG. 1D. Hammer 81 also includes a downwardly facing shoulder 87 which is adapted to engage upwardly facing shoulder 49 of knocker sub 31.

Referring now to FIGS. 1A and 1B, apparatus 11 includes valve means, designated generally by the numeral 89, for closing mandrel flow passage 59. Valve means 89 includes a ball closure member 91 which is mounted for axial movement into and out of engagement with a seat 93 in piston 61 of mandrel 57 by an axially extending dart 95. Dart 95 is slidingly mounted in a bushing 97 formed in the lower end of lower top sub 19. Dart 95 has the cross sectional configuration of a cross and is formed to define a plurality of flow passages, including flow passage 99. The upper end of dart 95 includes a plurality of outwardly extending ribs, including rib 101 which define shoulders 103. Shoulders 103 cooperate with a shoulder 105 formed internally of lower top sub 19 of body 13 to contain a compression spring 107, which urges dart 95 and closure 91 axially upwardly with respect to body 13. The downward movement of dart 95 with respect to body 11 is limited by a radially inwardly extending shoulder 115 in body 11 which cooperates with shoulder 103 of dart 95. The limited downward motion of dart 95 with respect to body 11 causes the opening of valve means 89 upon a predetermined downward travel of mandrel 57 with respect to body 11, as will be described in detail hereinafter.

After the opening of valve 89, spring 107 urges dart 95 axially upwardly and away from piston 61. Dart 95 includes an axially upwardly facing valve member 117, which is adapted to engage momentarily a seat 119 defined in the end of a conduit 121 connected to an axially downwardly extending end top sub 15 of body 13. The engagement of valve member 117 with seat 119 temporarily interrupts the flow of fluid through apparatus 11 and facilitates the upward movement of mandrel 59 with respect to body 13, as will be described hereinafter.

Referring now to FIG. 1C, the lower end of lower tubular portion 67 of mandrel 57 is formed to define a downwardly facing shoulder 109 which cooperates with an upwardly facing shoulder 111 defined by the upper end of hammer sub 27 of body 13 to compress therebetween a main spring 113. Main spring 113 is chosen to have a high spring constant and serves to urge mandrel 57 upwardly with respect to body 13.

Figure 11A:
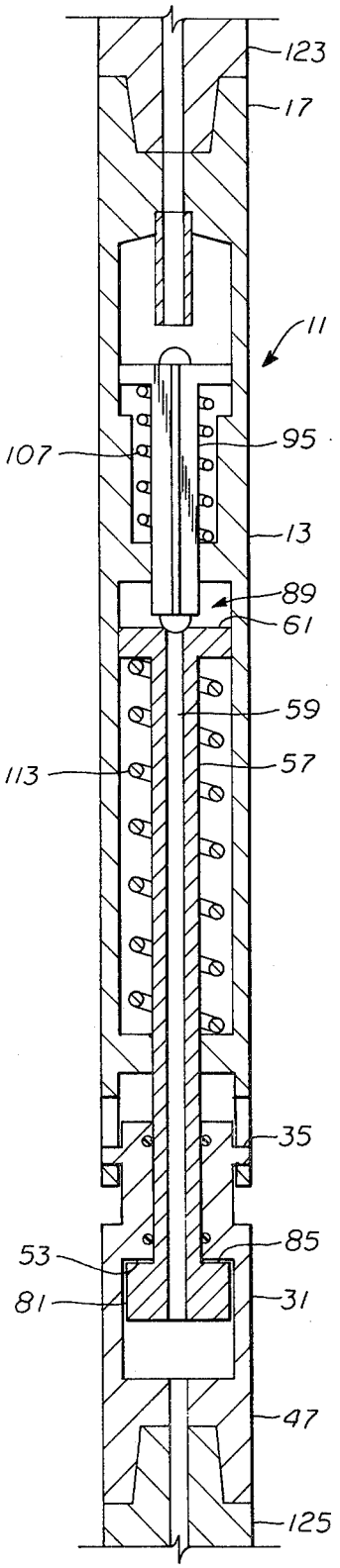
FIGS. 11A–11C are schematic sequential operational views of the present invention in the upwardly jarring mode.
Figure 11B:
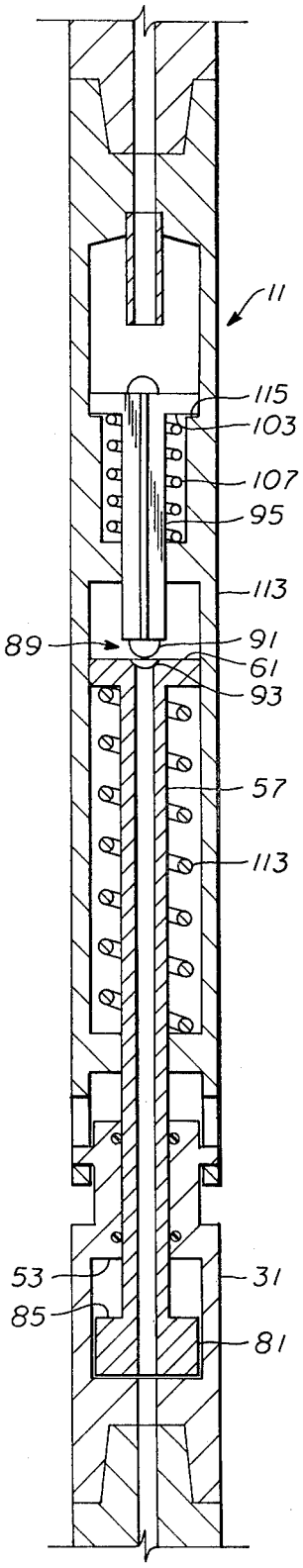
Figure 11C:
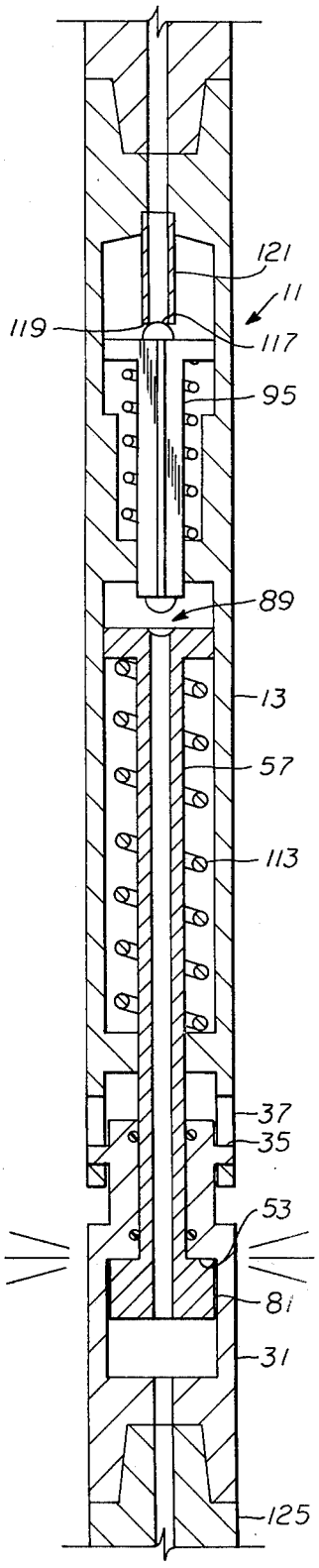
Figure 12A:
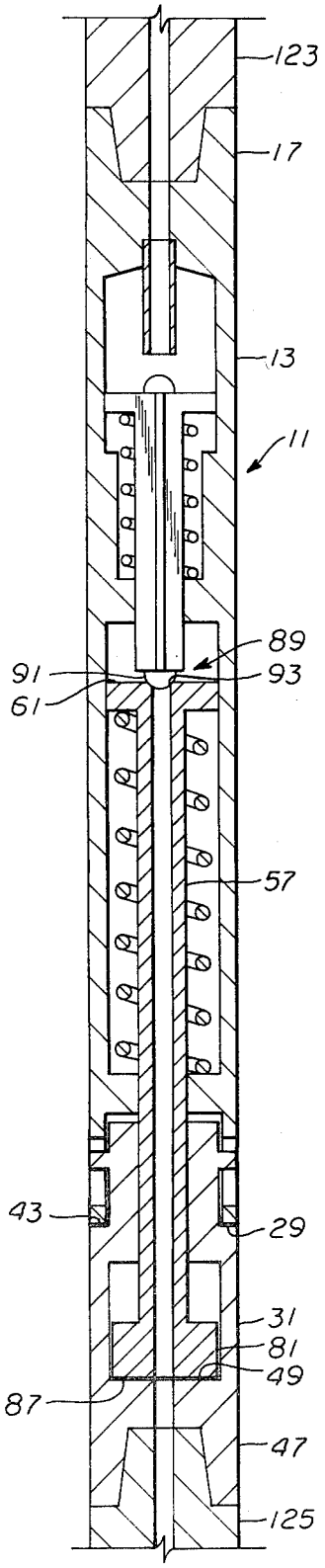
FIGS. 12A–12C are schematic sequential operational views of the invention in the downwardly jarring mode.
Figure 12B:
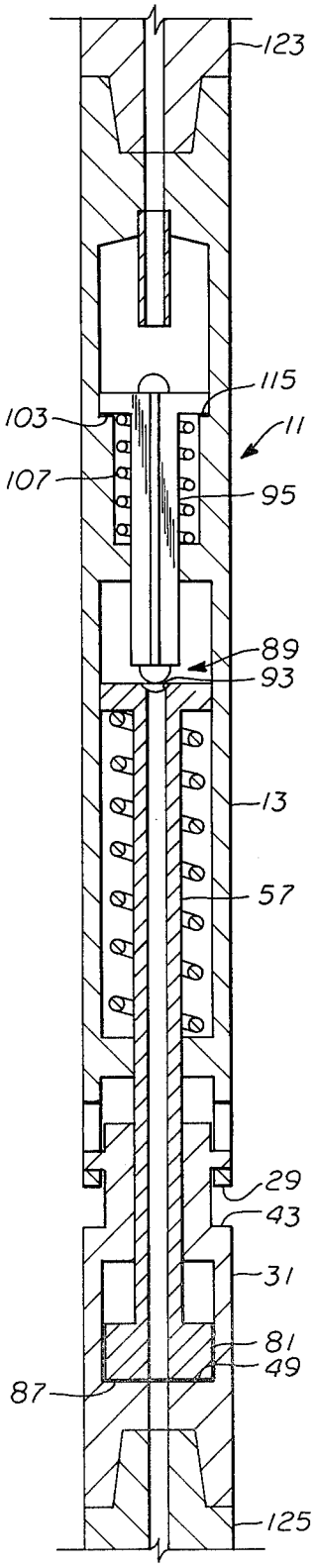
Figure 12C:
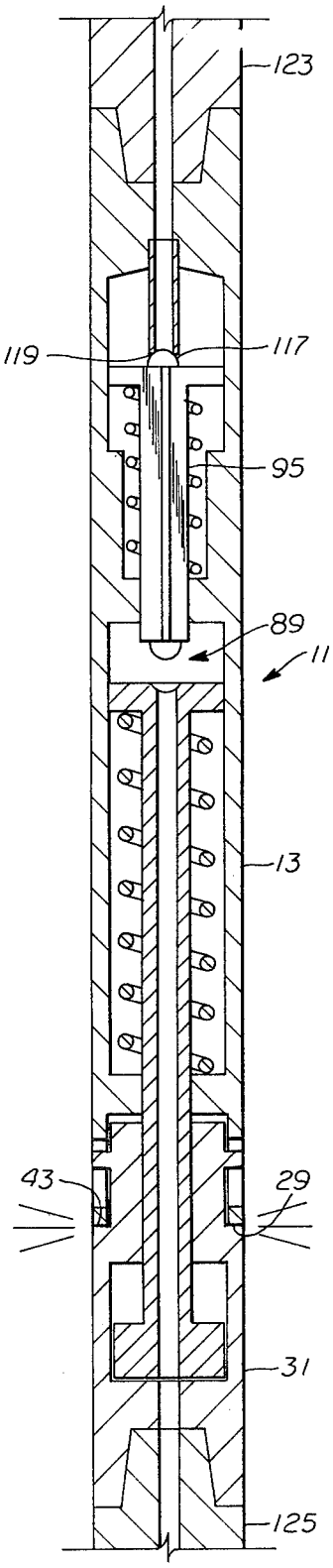

The basic operation of apparatus 11 may be understood by referring to FIGS. 11A–11C, which depict the apparatus in operation in the upstroke mode, and FIGS. 12A–12C, which depict the operation of the apparatus in the downstroke mode.

Referring first to FIGS. 11A–11B, apparatus 11 is shown with a tubular member 123 connected at upper pipe connection 17 of body 13 and a tubular member 125 connected at pipe connection 47 of knocker sub 31. It will be understood that tubular member 123 is connected to the surface and that tubular member 125 extends downhole and may be connected to a fishing tool, or the like. It will be visualized in FIGS. 11A–11C that tubular member 125 is in one way or another stuck and resistant to upward movement. An upward force is applied to tubular member 123 which causes apparatus 11 to be in tension with knocker sub 31 in an extended position with respect to body 13 with the tension force being transmitted to knocker sub 31 via pins 35.

At the instant depicted in FIG. 11A, valve 89 is closed and fluid pressure within the upper portion of body 13 acts on the effective area of dart 95 and piston 61 of mandrel 57 to urge dart 95 and mandrel 57 axially downwardly to space apart upwardly facing shoulder 85 of hammer 81 from downwardly facing shoulder 53 of knocker sub 31. When valve 89 is closed, the pressure within flow passage 59 of mandrel 57 is less than the pressure within the upper portion of body 13. Thus, dart 95 is urged continually into sealing contact with mandrel 57 and moves therewith as a unit. The downward movement of dart 95 and mandrel 57 compresses both spring 107 and main spring 113.

Referring now to FIG. 11B, apparatus 11 is shown at a instant immediately after shoulder 103 of dart 95 contacts shoulder 115 of body 13, thereby to limit the downward movement of dart 95. Fluid pressure applied to the upper surface of piston 61 continues to urge mandrel 57 downwardly, which breaks the seal between ball closure member 91 and seat 93. When the seal between ball 91 and seat 93 is broken, the differential pressure across dart 95 is effectively removed and dart 95 is free to move axially upwardly under the influence of spring 107. Additionally, mandrel 57 is free to move axially upwardly under the influence of main spring 113.

Referring now to FIG. 11C, apparatus 11 is shown at yet a further instant after the opening of valve 89. Dart 95 is shown at its fully axially upward position at which valve member 117 is engaged with seat 119 of conduit 121, thereby to interrupt momentarily the flow of fluid through apparatus 11. Mandrel 57 has moved sharply upwardly under the influence of main spring 113 such that hammer 81 applies a sharp jarring blow to internal anvil 53 of knocker sub 31, which jarring blow is transmitted to tubular member 125. Should the blow move tubular member 125 upwardly, knocker sub 31 is free to move upwardly with respect to body 13 by the sliding action of pins 35 within slots 37.

After the impact of hammer 81 upon internal anvil 53 of knocker sub 31, apparatus 11 returns to the position depicted in FIG. 11A, whereupon the operating cycle described above is repeated. At typical pressures and flow rates, the tool operates at many cycles per second and a upwardly jarring action is created. The upwardly jarring action will continue as long as apparatus 11 is in tension and fluid flow is maintained.

Referring now to FIGS. 12A–12C, apparatus 11 is depicted in operation in the downwardly jarring mode. Again, a tubular member 123 is connected at upper connection 17 of body 13 and a tubular member 125 is connected at pipe connection 47 of knocker sub 31. However, in FIGS. 12A–12C it will be visualized that tubular member 125 is resistant to downward movement and that apparatus 11 is in a state of compression due to the weight of tubular member 123 and other equipment above apparatus 11. Thus, as shown in FIG. 12A, knocker sub 31 is in a retracted position with respect to body 13 and body hammer 29 is in contract with external anvil 43 of knocker sub 31.

In FIG. 12A, apparatus 11 is shown at the commencement of the downward jarring cycle. Valve 89 is closed, with ball closure member 91 seated on seat 93. Thus, fluid pressure within the upper portion body 13 exerts a downward force upon the upper surface of piston 61 which is transmitted through mandrel 57 to hammer 81. However, tubular member 125 and knocker sub 31 are resistant to downward movement. Accordingly, the downward force of mandrel 57 is delivered across downwardly facing shoulder 87 of hammer 81 to upwardly facing shoulder 49 of knocker sub 31. Thus, the fluid force upon piston 61 is transmitted to tubular member 125. Since tubular member 125 cannot move downwardly under the influence of such fluid force, body 13 and tubular member 123 move upwardly thereby to space apart body hammer 43 from external anvil 29 of knocker sub 31.

In FIG. 12B, apparatus 11 is shown an instant after shoulder 103 of dart 95 has bottomed out on shoulder 115 of body 13. The fluid pressure has in effect lifted ball closure member 91 off seat 93 thereby to open valve 89. Again, when valve 89 opens, dart 95 moves upwardly under the influence of spring 107. Additionally, when valve 89 opens, the fluid energy that has in effect lifted body 13 and tubular member 123 upwardly with respect to knocker sub 31 and tubular member 125 is released thereby allowing tubular member 123 and body 13 to fall axially downwardly.

FIG. 12C depicts the operation of apparatus 11 at the moment of downward impact with mandrel hammer 29 sharply striking external anvil 43 of knocker sub 31. The energy developed during the substantially free fall of body 13 and tubular member 123 is delivered substantially instantaneously to knocker sub 31 and to tubular member 125. Valve member 117 of dart 95 is shown seated against seat 119, thereby to interrupt momentarily the flow of fluid through apparatus 11, thereby to increase the sharpness of the blow.

Immediately after the downward jar, as shown in FIG. 12C, valve 89 closes to return apparatus 11 to the position as shown in FIG. 12A. In the downwardly jarring mode with normal pressures and flow rates, apparatus 11 sets up a strong jarring action delivering many blows per second. The downward jarring action continues as long as apparatus 11 is in compression.

Since main spring 113 is in effect stronger than spring 107, under certain flow and pressure conditions, particularly in the upstroke mode, mandrel 57 may travel axially upwardly faster than dart 95 such that valve 89 recloses prior to impact. When such premature closing occurs, the jarring force is either eliminated or greatly reduced. Accordingly, means may be provided for delaying or releasably preventing the upward travel of mandrel 57 after the opening of valve 89 to allow dart 95 to travel well clear of mandrel 57.

Referring to FIG. 1B, one embodiment of the delaying or releasable preventing means is indicated generally at 127. Releasable preventing means 127 includes a frusto-conical camming surface 129 defined in releasable preventing means sub 23. Positioned adjacent camming surface 129 is an elastically deformable bushing 131, which in the preferred embodiment is made of nylon. Bushing 131 includes a frusto-conical outer surface 133, which is cooperative with camming surface 129. Bushing 131 is normally urged axially upward against a shoulder 135 by a spring 137. Releasable preventing means 127 additionally includes a frusto conical surface 139 defined in upper tubular portion 63 of mandrel 57.

When mandrel 57 moves downwardly during operation of the tool, surface 139 engages the upper end of bushing 131 and carries bushing 131 axially downwardly until spring 137 is fully compressed or until a bottom shoulder 141 of bushing 131 engages a shoulder 143, thereby to prevent further axial downward movement of bushing 131. When downward axial movement of bushing 131 is so prevented, further downward movement of mandrel 57 causes surface 139 to deform outwardly bushing 131. When valve 89 opens and mandrel 57 is urged upwardly, bushing 131 tends to be carried with mandrel 57. Any initial upward movement of mandrel 57 and bushing 131 tends to wedge outer surface 133 of bushing 131 into engagement with camming surface 129. The wedging enterengagement of bushing 131 with camming surface 129 and surface 139 of mandrel 57 causes a temporary sticking of mandrel 57 which allows dart 95 to travel while clear. After a short time, the strong upward urging upon mandrel 57 causes surface 139 to become free of bushing 131, whereupon mandrel 57 travels sharply upwardly to deliver the impact. After release of the connection between bushing 131 and mandrel 57, bushing 131 travels axially upwardly under the influence of spring 137 to the position shown in FIG. 1B.

Figure 9:
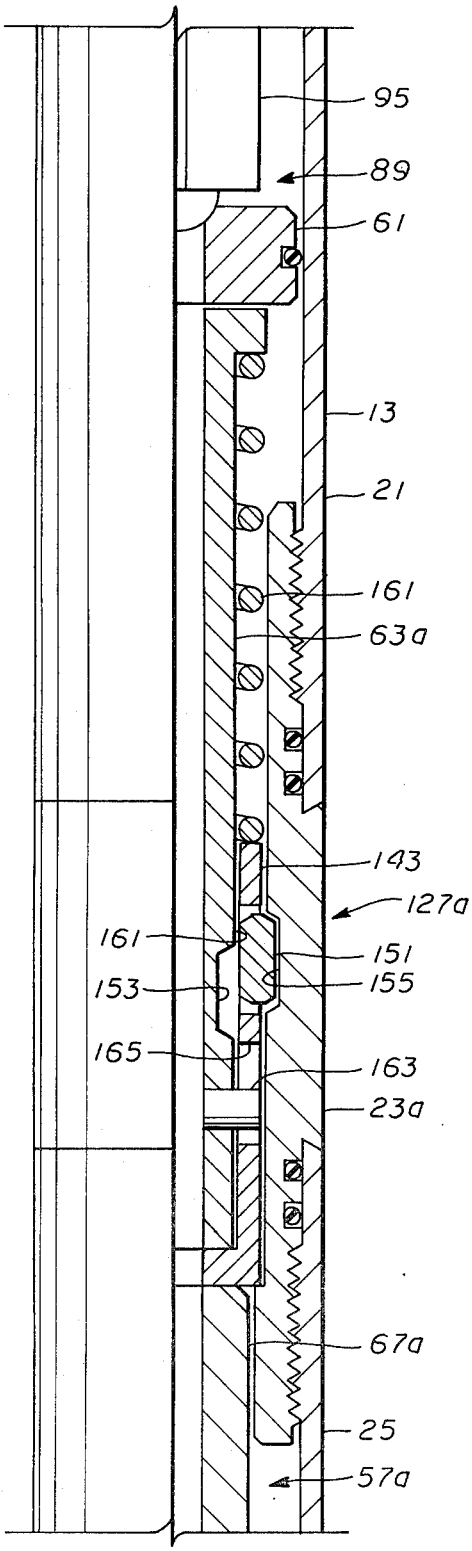
FIG. 9 is a quarter sectional view of the portion of the apparatus of the present invention showing a second alternative embodiment of the releasable preventing means of the present invention shown in the locked position.
Figure 10:
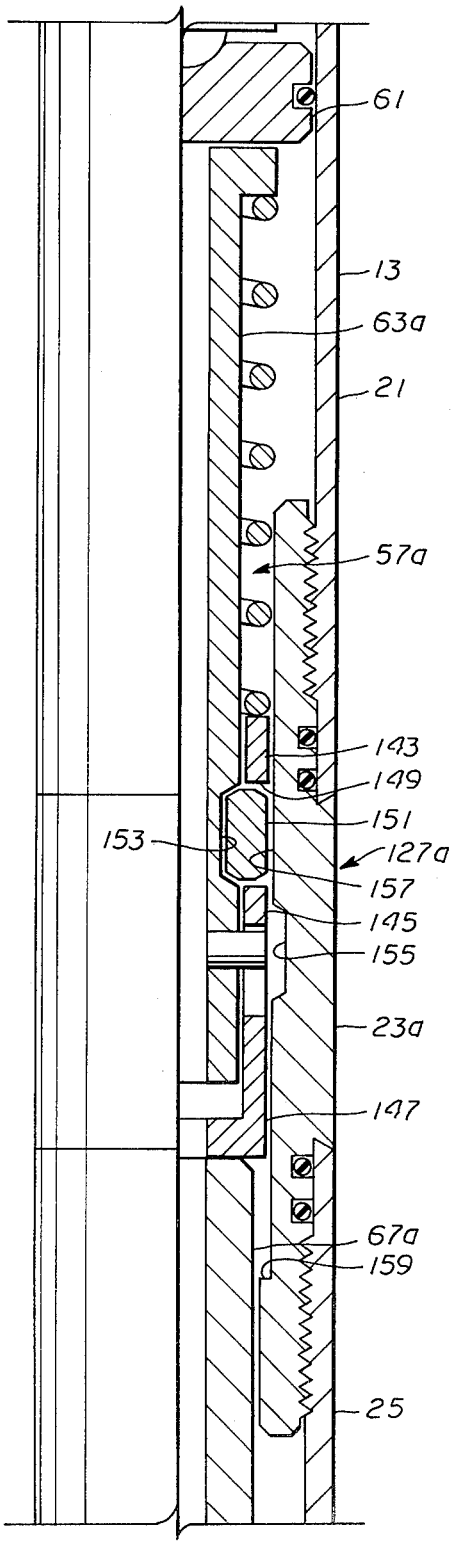
FIG. 10 is a quarter sectional view similar to FIG. 9 showing the second alternative embodiment of the releasable preventing means in the unlocked position.

Referring now to FIGS. 9 and 10, there is shown an alternative embodiment of the releasable preventing means of the present invention, which is designated generally by the numeral **127*a*. Referring first to FIG. 10, which shows releasable preventing means 127*a* in the unlocked position, mandrel 57***a* includes an upward tubular portion 63*a* and a lower tubular portion 67*a*. A locking sleeve 143 is positioned between releasable preventing means sub 123 of body 13 and mandrel 57*a*. Locking sleeve 143 includes a tubular portion 145 positioned about upper tubular portion 63*a* of mandrel 57*a* and a radially inwardly extending ring 147 positioned axially between upper tubular portion 63*a* and lower tubular portion 67*a* of mandrel 57*a*.

Tubular portion 145 of locking sleeve 143 includes preferably a plurality of locking ports 149 spaced circumferentially thereabout. Each locking port 149 has mounted for radial movement therein a locking segment 151. Locking segment 151 is movable radially between a radially inwardly extending recess 153 defined in upper tubular portion 63*a* of mandrel 57*a*, as shown in FIG. 10, and a radially outwardly extending recess 155 formed in releasable preventing means sub 123*a*, as shown in FIG. 9. In the position shown in FIG. 10, locking segment 151 is held in mandrel recess 153 by the interior surface 157 of releasable preventing means sub 123, and thus locks together upper tubular portion 63*a* of mandrel 57*a* and locking sleeve 143. Downward movement of upper tubular portion 63*a* is transmitted through locking segment 157 to locking sleeve 143 and thence to lower tubular portion 67*a*. When locking segment 151 comes into axial registry with body recess 155, further axially downward movement of locking sleeve 143 is prevented by the action of a shoulder 159 defined at the lower end of sub 23*a*. It will be noted that the engagement of locking sleeve 143 with shoulder 159 prevents further downward motion of lower tubular portion 67*a* and mandrel 57*a*. However, after engagement of locking sleeve 143 with shoulder 59, upper tubular portion 63*a* continues to move downwardly and such movements cams or urges locking segment 151 into engagement with body recess 155, which functionally disconnects upper tubular portion 63*a* from locking sleeve 143.

As is shown in FIG. 9, after locking segment 151 has moved into body recess 155, locking segement 151 is held in place by external surface 161 of upper tubular portion 63*a*. Thus, in the position shown in FIG. 9, lower tubular portion 67*a* of mandrel 57*a* and body 13 are locked together.

When valve 89 opens, thereby allowing dart 95 to move upwardly, upper tubular portion 63*a* moves upwardly under the influence of a spring 161 independently of locking sleeve 143 and the rest of mandrel 57*a*. Spring 161 has a spring constant selected such that upper tubular portion 63*a* moves upwardly more slowly than dart 95. When mandrel recess 153 comes into axial registry with segment 151, a pin 163 connected to and extending radially outwardly from, engages the top of a slot 165 in locking sleeve 143. Pin 163 and slot 165 cooperate to pull locking sleeve 143 axially upwardly with respect to body 13, which cams locking segment 151 back into mandrel recess 153. When locking segment 151 is cammed out of body recess 155, thereby functionally disconnecting mandrel 57 from body 13.

Figure 6:
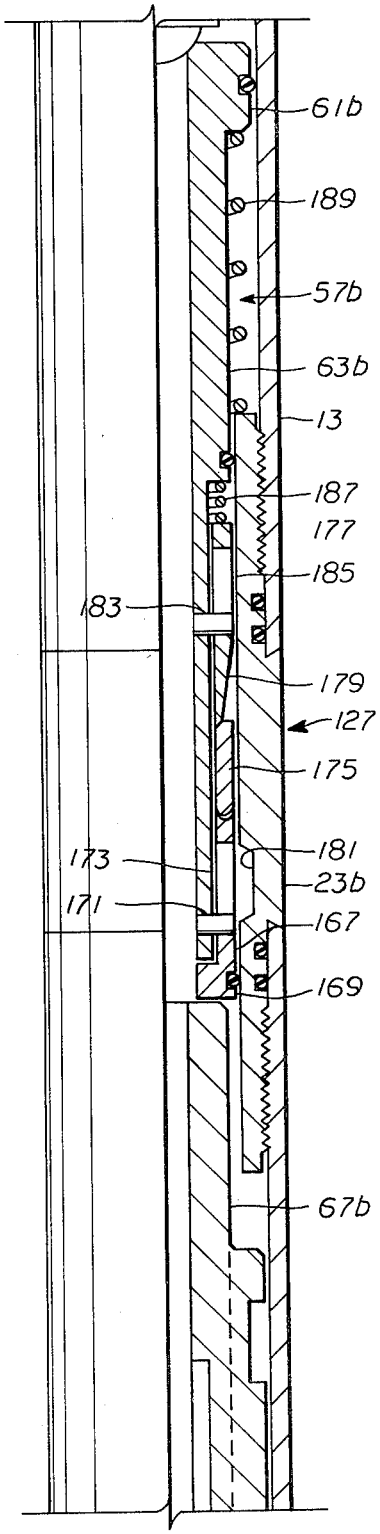
FIG. 6 is a quarter section view of a portion of the present invention showing details of an alternative embodiment of the releasable preventing means of the present invention.
Figure 7:
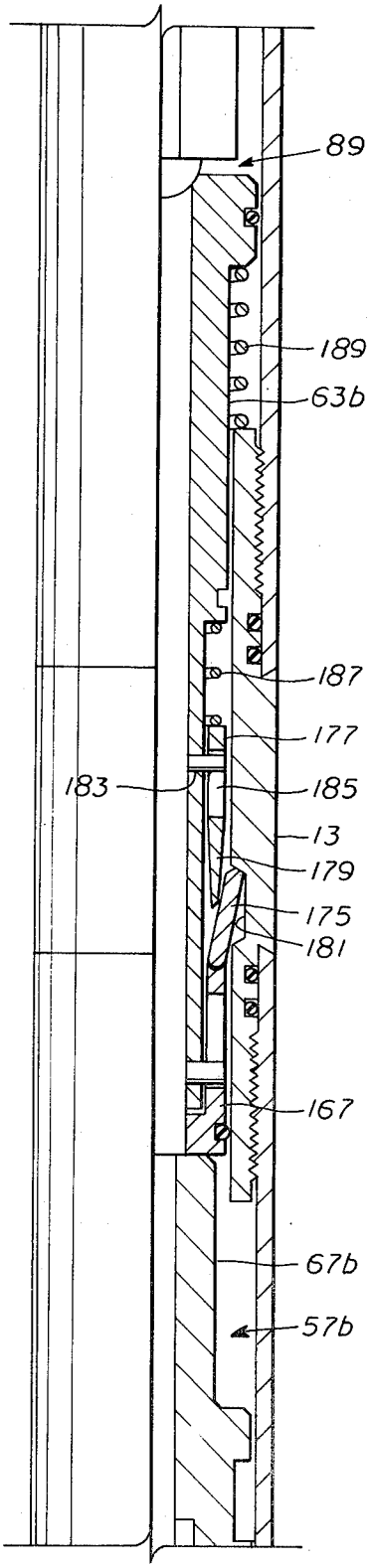
FIG. 7 is a quarter sectional view similar to FIG. 6 showing a phase of operation of the alternative releasable preventing means of the present invention.
Figure 8:
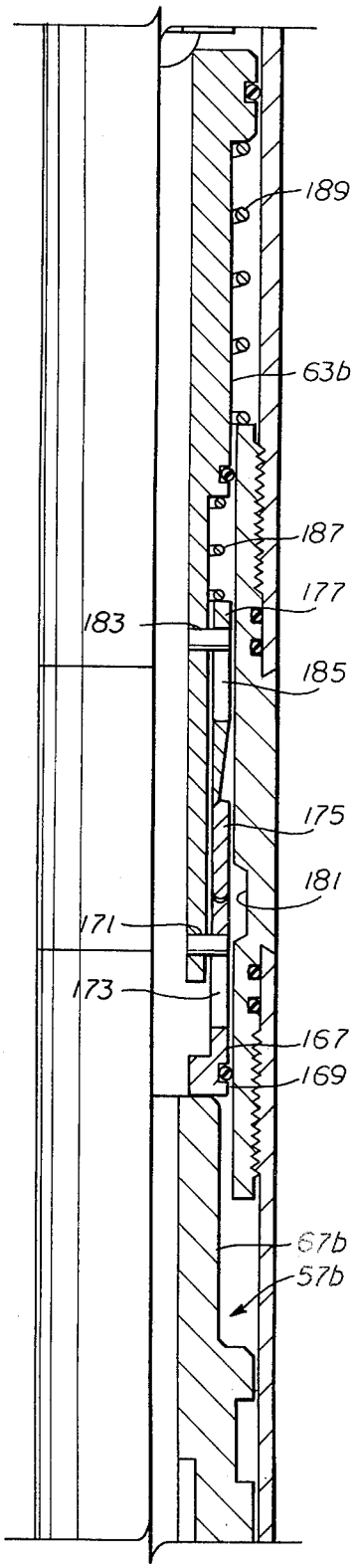
FIG. 8 is a quarter sectional view similar to FIGS. 6 and 7 showing a further phase of operation of the alternative releasable preventing means.

Referring now to FIGS. 6–8, there is shown a second alternative embodiment of the releasable preventing means, which is designated generally by the numeral 127*b*. Releasable preventing means 127*b* includes a first locking sleeve 167 positioned between releasable preventing means sub 23*b* and upper tubular portion 63*b* of mandrel 57*b*. It will be noted that in the embodiment shown in FIGS. 6–8, upper portion 63*b* of mandrel 57*b* is a unitary structure with piston 61*b*. First locking sleeve 167 includes an inwardly extending ring 169, which is postioned between upper tubular portion 63*b* and lower tubular portion 67*b* of mandrel 57*b*. Upper tubular portion 63*b* includes a first radially outwardly extending pin 171, which engages a slot 173 defined in first locking sleeve 167 for limited axial movement therebetween.

Releasable preventing means 127*b* includes preferably a plurality of locking segments, including a locking segment 175 which is pivotally supported by first locking sleeve 167. Locking segment 175 is normally positioned in sliding relationship between upper tubular portion 63*b* and releasable preventing means sub 23*b*. However, a second locking sleeve 177 which includes a camming surface 179 is provided for pivoting locking segment 175 radially outwardly into engagement with a body recess 181 in sub 23*b*, as shown in FIG. 7.

Second locking sleeve 177 is connected for limited axial movement with respect to upper tubular portion 63*b* by a second pin 183 which engages a slot 185 and second locking ring 177. A spring 187 is provided for urging second locking ring 177 axially downwardly.

A spring 189 is provided for urging upper tubular portion 63*b* and piston 61*b* axially upwardly with respect to body 13. Spring 189 is selected to have a spring constant such that it urges upper tubular portion 63*b* upwardly more slowly than dart 95.

In operation, the apparatus is initially in the configuration shown in FIG. 6. Downward movement of piston 61*b* is transmitted through upper tubular portion 63*b* and first locking sleeve 167 to lower tubular portion 67*b* of mandrel 57*b*. When the upper end of locking segment 175 comes into axial registry with body recess 181, spring 187, which is normally compressed, extends to urge second locking sleeve 177 axially downwardly with respect to upper tubular portion 63*b*, thereby to pivot outwardly locking segment 175 into body recess 181, as shown in FIG. 7.

Upon initial opening of valve 89, the upward force of the main spring is transmitted through lower tubular portion 67*b* of mandrel 57*b* through first locking sleeve 167 and locking segment 175 into body 13. However, upper tubular portion 63*b* is free to move upwardly under the influence of spring 189 independent of lower tubular portion 67*b*. As upper tubular portion 63*b* moves upwardly, pin 183 engages the top of slot 185 to pull second locking sleeve 177 axially upwardly. As second locking sleeve 177 moves upwardly, locking segment 175 pivots inwardly and out of engagement with body recess 181. As shown in FIG. 8, when segment 175 pivots completely out of body recess 181, upper portion 63*b* continues to move upwardly and lower tubular portion 67*b* of mandrel 57*b* is free to move upwardly to deliver the jarring blow.

From the foregoing it will be seen that this invention is one well adapted to attain all of the ends and objects hereinabove set forth together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof it is to be understood that all matters herein set forth are shown in the accompanying drawings as to be interpreted as illustrative and not in a limiting sense.

What is claimed is:

1. A bidirectional fluid operated jarring apparatus, which comprises:

a tubular body having an axially upper end defining a pipe connection and an axially lower end defining downwardly facing body hammer;

a tubular knocker sub having an axially upper end axially movably connected to said lower end of said body for limited axial movement with respect to said body between retracted and extended positions, and an axially lower end defining a pipe connection, said knocker sub including an upwardly facing shoulder defining an upwardly facing anvil engageable with said body hammer, and said knocker sub including an inwardly extending downwardly facing internal shoulder defining a downwardly facing internal anvil and an axially spaced apart upwardly facing inwardly extending internal shoulder;

a tubular mandrel having an axial flow passage therethrough axially movably mounted in said body and knocker sub, said mandrel including a mandrel hammer positioned within said knocker sub between said internal shoulders of said knocker sub, said mandrel hammer including an outwardly extending upwardly facing shoulder engageable with said downwardly facing anvil of said knocker sub when said knocker sub is in said extended position and an outwardly extending downwardly facing shoulder engageable with said upwardly facing internal shoulder of said knocker sub when said knocker sub is in said retracted position;

means for forming a sliding seal between said mandrel and said body;

means for urging said mandrel axially upwardly with respect to said body;

and valve means for closing said mandrel flow passage whereby fluid pressure urges said mandrel axially downwardly with respect to said body and opening said mandrel flow passage upon predetermined axially downward movement of said mandrel with respect to said body thereby to allow said mandrel to move axially upwardly with respect to said body such that when said knocker sub is in said extended position upward movement of said mandrel causes said mandrel hammer to strike said knocker sub internal anvil and when said knocker sub is in said retracted position downwardly urging fluid force on said mandrel is transmitted to said knocker sub through said upwardly facing internal shoulder and said body is urged upwardly with respect to said knocker sub and upon opening of said mandrel flow passage said body hammer strikes said knocker sub upwardly facing anvil.

2. The apparatus as claimed in claim 1, wherein said valve means includes:

a closure axially movably mounted in said body above said mandrel and seatable in said mandrel flow passage;

means for urging said closure axially upwardly with respect to said body;

and means for limiting the downward movement of said closure with respect to said body upon said predetermined axially downward movement of said mandrel.

3. The apparatus as claimed in claim 2, including means for momentarily releasably preventing axially upward movement of said mandrel after opening of said closure means.

4. The apparatus as claimed in claim 3, wherein said preventing means includes:

an annular elastically deformable bushing mounted between said mandrel and said body;

and a shoulder formed on said mandrel wedgingly engageable with said bushing upon downward movement of said mandrel with respect to said body.

5. The apparatus as claimed in claim 4, wherein:

said body includes an axially extended radial enlarged space containing said bushing, and said preventing means includes means for urging said bushing axially upwardly within said space.

6. The apparatus as claimed in claim 3, wherein:

said mandrel includes an axially lower portion and an axially upper portion axially aligned with said lower portion and said preventing means includes;

a locking sleeve between said body and said mandrel, said sleeve including an inwardly extending ring positioned between said upper and lower portions of said mandrel, and said sleeve having formed therein a radial locking port;

means for allowing limited axial movement of said locking sleeve with respect to said upper portion of said mandrel;

means for urging said upper portion of said mandrel axially upwardly with respect to said locking sleeve;

a radially inwardly extending mandrel recess formed in said mandrel;

a radially outwardly extending body recess formed in said body;

and a locking segment radial movably positioned in said locking port and movable into said body recess to interlock said body and locking sleeve upon said predetermined downward movement of said mandrel, and movable into said mandrel recess upon upward movement of said upper portion of said mandrel with respect to said locking sleeve thereby to release said body and locking sleeve.

7. The apparatus as claimed in claim 3, wherein said mandrel includes an axially lower portion and an axially upper portion, and said preventing means includes:

a first locking sleeve positioned between said mandrel and said body and including an inwardly extending locking ring positioned between said upper and lower portions of said mandrel;

means for allowing limited axial movement between said first locking sleeve and said upper portion of said mandrel;

a second locking sleeve axially upwardly spaced apart from said first locking sleeve and positioned between said body and said upper portion of said mandrel, said second locking sleeve including a downwardly and inwardly tapered exterior camming surface;

means for allowing limited axial movement of said second locking sleeve with respect to said upper portion of said mandrel;

means for urging said upper portion off said mandrel upwardly with respect to said body;

a radially outwardly extending body recess formed in said body;

a locking segment positioned between said first sleeve and said second locking sleeve between said upper portion of said mandrel and said body;

and means for urging said second locking sleeve downwardly with respect to said mandrel to cam said locking segment radially outwardly and into engagement with said body recess when said locking segment and body recess are longitudinally aligned.

8. The apparatus as claimed in claim 1, including means for interrupting the flow of fluid into said body after said valve means opens to facilitate upward movement of said mandrel.

9. The apparatus as claimed in claim 8, wherein:

said valve means includes a dart axially movably mounted in said body axially above said mandrel, said dart including a downwardly facing closure sealingly engageable with said mandrel flow passage, means for urging said dart axially upwardly with respect to said body, and means for limiting the downward movement of said dart with respect to said body;

and said means for interrupting the flow of fluid includes a downwardly facing seat defined in said body above said dart, and an upwardly facing closure connected to said dart and engageable with said downwardly facing seat.

10. The apparatus as claimed in claim 1, including means for preventing axial rotation between said body and said knocker sub.

11. The apparatus as claimed in claim 1, wherein the connection between said body and said knocker sub includes:

a tubular connecting neck connected to said knocker sub and axially slidingly mounted in said body;

a plurality of axially extending slots formed in said body adjacent said connecting neck;

and a plurality of pins connected to said connecting neck and slidingly engaged with said slots.

12. A bidirectional fluid operated vibrating jar, which comprises:

a tubular body having an axially upper end and axially lower end, said lower end defining a downwardly facing body hammer;

a tubular mandrel axially sealingly movably mounted in said body and said mandrel including a radially outwardly extended mandrel hammer at the axially lower end thereof, said mandrel hammer including axially spaced apart oppositely facing shoulders;

a knocker sub axially movably positioned at said lower end of said body and including an internal bore and radially enlarged cavity defined by axially spaced apart inwardly extending oppositely facing shoulder, said bore and cavity having said mandrel and mandrel hammer axially movable mounted therein with the axial spacing between said inwardly extending shoulders of said knocker sub cavity being greater than the axial spacing of said outwardly directed shoulders of said mandrel hammer, and said knocker sub including a shoulder engageable with said body hammer;

means for allowing limited axial movement of said knocker sub with respect to said body;

means for urging said mandrel upwardly with respect to said body;

and valve means for closing said mandrel flow passage whereby fluid pressure urges said mandrel axially downwardly with respect to said body and for opening said mandrel flow passage upon predetermined axially downward movement of said mandrel with respect to said body.

* * * * *